252-97 AU 115 EX
6/2/87 XR 4,670,179

United States Patent [19]
Inamorato et al.

[11] Patent Number: 4,670,179
[45] Date of Patent: Jun. 2, 1987

[54] STABILIZED BUILT SINGLE PHASE LIQUID DETERGENT COMPOSITION CONTAINING ENZYMES

[75] Inventors: Jack T. Inamorato, Westfield; Michael C. Crossin, Kendall Park, both of N.J.

[73] Assignee: Colgate Palmolive Company, New York, N.Y.

[21] Appl. No.: 870,647

[22] Filed: May 29, 1986

[51] Int. Cl.[4] ..... C11D 1/66; C11D 7/42; C11D 17/00; C11D 1/88

[52] U.S. Cl. ..... 252/174; 252/97; 252/109; 252/139; 252/174.12; 252/DIG. 12; 252/DIG. 14

[58] Field of Search ..... 252/97, 109, 139, 174, 252/174.12, DIG. 12, DIG. 14

[56] References Cited

U.S. PATENT DOCUMENTS

| | | | |
|---|---|---|---|
| 4,021,377 | 5/1977 | Borchert et al. | 252/546 |
| 4,169,817 | 10/1979 | Weber | 252/545 |
| 4,243,543 | 1/1981 | Guilbert et al. | 252/105 |
| 4,261,868 | 4/1981 | Hora et al. | 252/529 |

FOREIGN PATENT DOCUMENTS 2079305 1/1982 United Kingdom .

*Primary Examiner*—John E. Kittle
*Assistant Examiner*—Mukund J. Shah
*Attorney, Agent, or Firm*—B. Lieberman; M. M. Grill; H. S. Sylvester

[57] ABSTRACT

A stabilized built single-phase enzyme-containing liquid detergent composition is provided comprising:

(a) from about 3 to 10%, by weight, of a surface active nonionic detergent compounds;
(b) from about 3 to 15%, by weight, of a surface active amphoteric detergent compound;
(c) from about 5 to 25%, by weight, of a water-soluble non-phosphate detergent builder salt;
(d) an effective amount of an enzyme or enzyme mixture selected from the group consisting of alkaline protease enzymes and alpha-amylase enzymes;
(e) from about 3 to 15%, by weight, of an enzyme stabilizing system consisting essentially of (i) glycerine and (ii) a boron compound selected from the group consisting of boric acid, boric oxide and alkali metal borates capable of reacting with said glycerine; and
(f) from about 30–85%, by weight, water; said liquid detergent composition being substantially free of cross-linked polyacrylate polymers.

19 Claims, No Drawings

STABILIZED BUILT SINGLE PHASE LIQUID DETERGENT COMPOSITION CONTAINING ENZYMES

This application is a continuation of application Ser. No. 728,150 filed Apr. 29, 1985, now abandoned, which is a continuation of Ser. No. 629,139 filed July 9, 1984, now abandoned, which is a continuation-in-part of Ser. No. 499,649 filed May 31, 1983 now abandoned.

This invention relates to stable, built, enzyme-containing liquid detergent compositions suitable for laundry or pre-soak formulations. More particularly, the invention relates to aqueous enzyme-containing liquid detergent compositions which contain a non-phosphate detergent builder and which are characterized by being physically stable, clear, single-phase homogeneous liquid compositions.

The formulation of stabilized enzyme-containing liquid detergent compositions has been the focus of much attention in the prior art. The desirability of incorporating enzymes into detergent compositions is primarily due to the effectiveness of proteolytic and amylolytic enzymes in decomposing proteinaceous and starchy materials found on soiled fabrics, thereby facilitating the removal of stains, such as, gravy stains, blood stains, chocolate stains and the like during laundering. However, enzymatic materials suitable for laundry compositions, particularly proteolytic enzymes, are relatively expensive. Indeed, they generally are the most expensive ingredient in a typical commercial liquid detergent composition, even when present in relatively minor amounts. Moreover, enzymes are known to be unstable in aqueous compositions. It is for this reason that an excess of enzymes is generally required in liquid detergent formulations to compensate for the expected loss of enzyme activity during prolonged periods of storage. Accordingly, the prior art is replete with suggestions for stabilizing enzyme-containing liquid detergent compositions, and in particular unbuilt liquid compositions by the use of various materials which are incorporated into the composition and serve as enzyme stabilizers.

In the case of liquid detergent compositions containing a builder, the problem of enzyme instability is particularly acute. Primarily this is because detergent builders have a destabilizing effect on enzymes, even in compositions containing enzyme stabilizers which are otherwise effective in unbuilt formulations. Moreover, the incorporation of a builder into a liquid detergent composition poses an additional problem, namely, the ability to form a stable single-phase solution, the solubility of sodium tripolyphosphate, for example, being relatively limited in aqueous compositions, and especially in the presence of anionic and nonionic detergents. Thus, for example, in U.K. Patent Application G.B. No. 2,079,305, published Jan. 20, 1982, there is disclosed an aqueous built enzyme-containing liquid detergent composition which is stabilized by a mixture of a polyol and boric acid. The compositions described in the examples, however, rather than being stable, clear, single-phase solutions, are instead turbid suspensions which are susceptible to product separation over prolonged periods of storage. Consequently, the problems of enzyme stability and physical product stability remain as problems yet to be overcome in formulating a commercially acceptable built enzyme-containing liquid detergent composition.

SUMMARY OF THE INVENTION

The present invention provides a stabilized aqueous, built, clear, single-phase, enzyme-containing liquid detergent composition comprising:

(a) from about 3 to 10%, by weight, of a surface active nonionic detergent compound;

(b) from about 3 to 15%, by weight, of a surface active amphoteric detergent compound;

(c) from about 5 to 25%, by weight, of a non-phosphate detergent builder salt;

(d) an effective amount of an enzyme or enzyme mixture selected from the group consisting of alkaline protease enzymes and alpha-amylase enzymes;

(e) from about 3 to 15%, by weight, of an enzyme stabilizing system consisting essentially of (i) glycerine and (ii) a boron compound selected from the group consisting of boric acid, boric oxide and alkali metal borates capable of reacting with said glycerin; and (f) from about 30 to 85%, by weight, water; said liquid detergent composition being substantially free of cross-linked polyacrylate polymers.

In accordance with the process of the invention, laundering of stained and/or soiled materials is effected by contacting such materials with an aqueous solution of the above-defined liquid detergent composition. Unlike the built, enzyme-containing detergent compositions known in the art, the compositions of the present invention are characteristically clear, single-phase homogeneous solutions which are physically stable over prolonged periods of storage and over a wide range of temperature. They are preferably substantially free of phosphate builder salts.

The use of a mixture of nonionic and amphoteric surface active detergent compounds in accordance with the invention enables such surfactants and the non-phosphate builder to be sufficiently solubilized in an aqueous composition so as to form a homogeneous single-phase solution. The nonionic detergent compound may constitute from about 3–10%, preferably from about 4–8%, by weight, of the detergent composition and the amphoteric detergent compound will generally vary from about 3–15%, preferably from about 4–10%, by weight, of such composition. The relative amount of each of the aforementioned detergents is generally determined by the amount of builder salt employed. For builder concentrations of from about 5 to 15%, by weight of the detergent composition, the amphoteric and nonionic detergents are typically each present in an amount from about 4 to 7%, by weight, the relative ratio of amphoteric to nonionic detergent being generally about 1. For builder concentrations within the range of about 15 to 25%, by weight, the amphoteric detergent is typically present from about 6 to 10%, by weight, and the relative ratio of amphoteric to nonionic detergent is preferably above 1, a ratio of from about 1.2 to about 1.6 being especially desirable, the higher ratios generally corresponding to higher concentrations of builder salt.

The liquid detergent compositions of the invention are preferably substantially free of polyacrylate polymers, namely, they contain less than 0.1%. by weight, and preferably below 0.05%, by weight, of polyacrylate polymers based on the total weight of composition.

DETAILED DESCRIPTION OF THE INVENTION

The enzyme stabilizing system of the invention is a mixture of glycerine and a boron compound selected from among boric acid, boric oxide and an alkali metal borate capable of reacting with glycerine. The weight of the stabilizing system in the present built detergent compositions is from about 3 to 15%, preferably 4 to 10%, by weight. Mixtures of glycerine and borax are especially useful for providing enzyme stability, the weight ratio of glycerine to borax in such stabilizing mixtures being generally from about 1.2 to 3, a ratio of from about 1.5 to 2.5 being preferred. Accordingly, the preferred amount of glycerine in the composition is from about 3 to 7%, and the preferred amount of borax is from about 1 to 4%, based on the weight of the composition.

The alkaline proteolytic enzymes suitable for the present compositions include the various commercial liquid enzyme preparations which have been adapted for use in detergent compositions, enzyme preparations in powdered form being also useful although, as a general rule, less convenient for incorporation into the built liquid detergent compositions. Thus, suitable liquid enzyme preparations include "Alcalase" and "Esperase" sold by Novo Industries, Copenhagen, Denmark, and "Maxatase" and "AZ-Protease" sold by Gist-Brocades, Delft, The Netherlands.

Among the suitable α-amylase liquid enzyme preparations are those sold by Novo Industries and Gist-Brocades under the tradenames "Termamyl" and "Maxamyl", respectively. "Esperase" is particularly preferred for the present compositions because of its optimized activity at the higher pH values corresponding to the built detergent compositions.

The synthetic nonionic and amphoteric detergents employed in the practice of the invention may be any of a wide variety of such compounds which are well known and are described at length in the text *Surface Active Agents*, Vol. II, by Schwartz, Perry and Berch, published in 1958 by Interscience Publishers, the relevant disclosures of which are hereby incorporated by reference.

The nonionic detergents are usually poly-lower alkoxylated lipophiles wherein the desired hydrophile-lipophile balance is obtained from addition of a hydrophilic poly-lower alkoxy group to a lipophilic moiety. For the present compositions the nonionic detergent employed is preferably a poly-lower alkoxylated higher alkanol wherein the alkanol is of 10 to 18 carbon atoms and wherein the number of moles of lower alkylene oxide (of 2 or 3 carbon atoms) is from 3 to 12. Of course materials it is preferred to employ those wherein the higher alkanol is a higher fatty alcohol of 11 or 12 to 15 carbon atoms and which contain from 5 to 8 or 5 to 9 lower alkoxy groups per mole. Preferably, the lower alkoxy is ethoxy but in some instances it may be desirably mixed with propoxy, the latter, if present, usually being a minor (less than 50%) constituent. Exemplary of such compounds are those wherein the alkanol is of 12 to 15 carbon atoms and which contain about 7 ethylene oxide groups per mole, e.g., Neodol ® 25-7 and Neodol 23-6.5, which products are made by Shell Chemical Company, Inc. The former is a condensation product of a mixture of higher fatty alcohols averaging about 12 to 15 Carbon atoms, with about 7 moles of ethylene oxide and the latter is a corresponding mixture wherein the carbon atom content of the higher fatty alcohol is 12 to 13 and the number of ethylene oxide groups per mole averages about 6.5. The higher alcohols are primary alkanols. Other examples of such detergents include Tergitol ® 15-S-7 and Tergitol 15-S-9, both of which are linear secondary alcohol ethoxylates made by Union Carbide Corporation. The former is a mixed ethoxylation product of an 11 to 15 carbon atoms linear secondary alkanol with seven moles of ethylene oxide and the latter is a similar product but with nine moles of ethylene oxide being reacted.

Also useful in the present compositions are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company. Other useful nonionics are represented by Plurafac B-26 (BASF Chemical Company), the reaction product of a higher linear alcohol and a mixture of ethylene and propylene oxides.

In the preferred poly-lower alkoxylated higher alkanols, the best balance of hydrophilic and lipophilic moieties are obtained when the number of lower alkoxies are from about 40% to 100% of the number of carbon atoms in the higher alcohol, preferably 40 to 60% thereof. The nonionic detergent is preferably comprised of at least 50% of the preferred ethoxylated alkanols. Higher molcular weight alkanols and various other normally solid nonionic detergent compounds and surfactants may contribute to gelation of the liquid detergent composition and consequently, are normally omitted or limited in quantity in the present compositions, although minor proportions thereof may be employed for their cleaning properties, etc. With respect to both preferred and less preferred nonionic detergents, the alkyl groups present therein are preferably linear although a minor degree of slight branching may be tolerated, such as at a carbon next to or two carbons removed from the terminal carbon of the straight chain and away from the ethoxy chain with the proviso that such branched alkyl is no more than three carbons in length. Normally the proportion of the carbon atoms in such a branched configuration will be minor, rarely exceeding 20% of the total carbon atom content of the alkyl. Similarly, although linear alkyls which are terminally joined to the ethylene oxide chains are highly preferred and are considered to result in the optimum combination of detergency, biodegradability and non-gelling characteristics, medial or secondary joinder to the ethylene oxide in the chain may occur. In such instance, it is usually in only a minor proportion of such alkyls, generally less than 20% but as is in the case of the aforementioned Tergitols, may be greater. Also, when propylene oxide is present in the lower alkylene oxide chain, it will usually be less than 20% thereof and preferably less than 10% thereof.

Amphoteric detergents include the higher fatty carboxylates, phosphates, sulfates or sulfonates which contain a cationic substituent such as an amino group, which may be quaternized, e.g., with a lower alkyl group, or chain extended at the amino group by condensation with a lower akylene oxide, e.g., ethylene oxide. Examples of suitable amphoteric detergents include: alkyl beta-amino dipropionates, $RN(C_2H_4COOM)_2$; alkyl beta-amino propionates, $RN(H)C_2H_4COOM$; and long chain imidazole derivatives having the general formula:

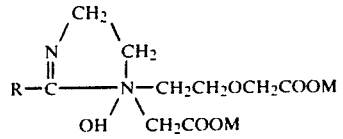

wherein in each of the above formulae R is an acyclic hydrophobic group containing from about 8 to 18 carbon atoms and M is a cation to neutralize the charge of the anion.

An anionic detergent may optionally also be employed in minor amounts to supplement the nonionic and amphoteric detergent compounds in the present liquid detergent compositions. Generally, the amount of anionic detergent will be below about 5%, by weight, and preferably, below about 3%, by weight, of the total composition because of the limited solubility of such detergents in the built liquid detergent compositions. Alkyl benzene sulfonate salts wherein the alkyl group contains 10 to 18 carbon atoms are particularly limited in solubility in the present compositions, and hence it is preferred that the present compositions be substantially free of such compounds to avoid the possibility of product separation.

The preferred anionic detergents for use herein are sulfated ethoxylated higher fatty alcohols of the formula $RO(C_2H_4O)_mSO_3M$, wherein R is a fatty alkyl of from 10 to 18 or 20 carbon atoms, m is from 2 to 6 or 8 (preferably having a value from about 1/5 to ½ the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms.

Ethylene oxide is the preferred lower alkylene oxide of the anionic alkoxylate detergent, and the proportion thereof in the polyethoxylated higher alkanol sulfate is preferably 2 to 5 moles of ethylene oxide groups present per mole of anionic detergent, with three moles being most preferred, especially when the higher alkanol is of 11 or 12 to 15 carbon atoms. To maintain the desired hydrophile-lipophile balance, when the carbon atom content of the alkyl chain is in the lower portion of the 10 to 18 carbon atom range, the ethylene oxide content of the detergent may be reduced to about two moles per mole whereas when the higher alkanol is of 16 to 18 carbon atoms, in the higher part of the range, the number is ethylene oxide groups may be increased to 4 or 5 and in some cases to as high as 8 or 9. Similarly, the salt-forming cation may be altered to obtain the best solubility. It may be any suitably solubilizing metal or radical but will most frequently be alkali metal, e.g., sodium, or ammonium. If lower alkylamine or alkanolamine groups are utilized the alkyls and alkanols will usually contain from 1 to 4 carbon atoms and the amines and alkanolamines may be mono-, di- and tri-substituted, as in monoethanolamine, diisopropanolamine and trimethylamine. A preferred polyethoxylated alcohol sulfate detergent is available from Shell Chemical Company and is marketed as Neodol 25-3S.

The non-phosphate detergent builder salts are employed in the present compositions in amounts generally of from about 5 to 25%, and preferably from about 10 to 20%, by weight. Specific examples of non-phosphorous water-soluble inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful and include the alkali metal, ammonium and substituted ammonium polyacetates, carboxylates, polycarboxylates and polyhydroxysulfonates. Specific examples of polyacetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

The percentage of water, the main solvent in the present compositions, will usually be from about 30 to 85%, preferably 45 to 75 % and most preferably from about 60 to 70%, by weight, of the liquid composition.

The optical fluorescent brighteners or whiteners employed in the liquid detergent compositions are important constituents of modern detergent compositions which give washed laundry and materials a bright appearance so that the laundry is not only clean but also appears clean. Although it is possible to utilize a single brightener for a specific intended purpose in the present liquid detergent compositions it is generally desirable to employ mixtures of brighteners which will have good brightening effects on cotton, nylons, polyesters and blends of such materials and which are also bleach stable. A good description of such types of optical brighteners is given in the article "The Requirements of Present Day Detergent Fluorescent Whitening Agents" by A. E. Siegrist, J. Am. Oil Chemists Soc., January 1978 (Vol. 55). That article and U.S. Pat. No. 3,812,041, issued May 21, 1974, both of which are hereby incorporated by reference contain detailed descriptions of a wide variety of suitable optical brighteners.

Among the brighteners that are useful in the present liquid detergent compositions are: Calcofluor 5BM (American Cyanamid); Tinopal LPW (Ciba); SOF A-2001 (Ciba); CDW (Hilton-Davis); Phorwite RKH, Phorwite BBH and Phorwite BHC (Verona); CSL, powder, acid (American Cyanamid); FB 766 (Verona); Blancophor PD (GAF); UNPA (Geigy); Tinopal RBS 200 (Geigy).

Adjuvants may be present in the liquid detergent compositions to provide additional properties, either functional or aesthetic. Included among the useful adjuvants are soil suspending or antiredoposition agents, such as polyvinyl alcohol, sodium carboxymethyl cellulose, hydroxypropylmethyl cellulose; thickeners, e.g., gums, alginates, agar agar; foam improvers, e.g., lauric myristic diethanolamide; foam destroyers, e.g., silicones; bactericides, e.g., tribromosalicylanilide, hexachlorophene; dyes; pigments (water dispersible); preservatives; ultraviolet absorbers; fabric softeners; opacifying agents, e.g., polystyrene suspensions; and perfumes. Of course, such materials will be selected based on the properties desired in the finished product, their compatibility with the other constituents, and their solubility in the liquid composition.

The present liquid compositions are efficient and easy to use. Compared to heavy duty laundry detergent powders, much smaller volumes of the present liquids are employed to obtain comparable cleaning of soiled laundry. For example, using a typical preferred formulation of this invention, only about 132 grams or ½ cup of liquid is needed for a full tub of wash in a top-loading automatic washing machine in which the water volume is 15 to 18 gallons (55 to 75 liters); and even less is needed for front-loading machines. Thus, the concentration of the liquid detergent composition in the wash water is on the order to about 0.2%. Usually, the proportion of the liquid composition in the wash solution will range from about 0.05 to 0.3%, preferably from 0.15 to 0.25% The proportions of the various constituents of the liquid composition may vary accordingly. Equivalent results can be obtained by using greater proportions of a more dilute formulation but the greater quantity needed will require additional packaging and will generally be less convenient for consumer use.

EXAMPLE 1

Enzyme-containing built liquid detergent compositions A–F were formulated as set forth below in Table 1. The percentages shown indicate weight percent.

TABLE 1

| | A | B | C | D | E | F |
|---|---|---|---|---|---|---|
| Ethoxylated $C_{12}$–$C_{15}$ primary alcohol (7 moles EO/mole alcohol) | 5.5% | 5.5% | 5.5% | 5.5% | 5.5% | 5.5% |
| Varion CADG[1] | 21 | 21 | 21 | 21 | 21 | 21 |
| Brightener | 0.2 | 0.2 | 0.2 | 0.2 | 0.2 | 0.2 |
| Sodium Nitriliotriacetate | 15 | 15 | 15 | 15 | 15 | 15 |
| PBB[2] | 1 | 1 | 1 | 1 | 1 | 1 |
| Perfume | 0.3 | 0.3 | 0.3 | 0.3 | 0.3 | 0.3 |
| Proteolytic enzyme[3] | 1 | 1 | 1 | 1 | 1 | 1 |
| glycerine | — | 5 | 5 | 5 | 5 | — |
| Borax | — | 1 | 2 | 3 | — | 3 |
| $H_2O$ | | | balance | | | |
| Percent active enzyme after 6 days at 110° F. | 12 | 62 | 73 | 76 | 21 | 28 |

[1]A 32% aqueous solution of coco-amido betaine sold by Sherex Chemical Company.
[2]Polar Brilliant Blue - a 1% active dye solution.
[3]"Esperase" sold by Novo Industries containing 5% enzyme, 75% propylene glycol, and balance $H_2O$ having an activity of 8.0 KNPU/gm. (Kilo Novo Protease units/gm).

The enzyme activities of compositions A–F were tested after 6 days storage at 110° F., the percent activity relative to the initial value being indicated in Table 1. A, E and F were the only compositions which did not contain an enzyme stabilizing system in accordance with the invention, and manifested a near total loss of enzyme activity after 6 days. Compositions B, C and D reflect the marked improvement of enzyme stability attendant to the inclusion of glycerine and borax in the detergent composition.

Compositions A through F were all clear, single-phase, homogeneous solutions which maintained their physical stability and clarity after 6 months of storage at both room temperature and at 110° F.

EXAMPLE 2

Enzyme-containing built liquid detergent compositions G and H were formulated essentially similar to compositions A–F except that sodium citrate was used as the builder salt instead of sodium NTA. The compositions are shown below in Table 2.

TABLE 2

| | G | H |
|---|---|---|
| Ethoxylated $C_{12}$–$C_{15}$ primary alcohol (7 moles EO/mole alcohol) | 5.5% | 5.5% |
| Varion CADG[1] | 21 | 21 |
| Brightener | 0.2 | 0.2 |
| Sodium citrate | 13 | 13 |
| PBB[2] | 1 | 1 |

TABLE 2-continued

| | G | H |
|---|---|---|
| Perfume | 0.3 | 0.3 |
| Proteolytic enzyme[3] | 1 | 1 |
| glycerine | — | 5 |
| Borax | — | 3 |
| $H_2O$ | balance | |
| Percent active enzyme after 6 days at 110° F. | 26 | 95 |

[1]A 32% aqueous solution of coco-amido betaine sold by Sherex Chemical Company.
[2]Polar Brilliant Blue - a 1% active dye solution.
[3]"Esperase" sold by Novo Industries containing 5% enzyme, 75% propylene glycol, and balance $H_2O$ having an activity of 8.0 KNPU/gm. (Kilo Novo Protease units/gm).

Composition H in accordance with the invention manifested an enzyme activity after 6 days of 95% as compared to composition G which contained no enzyme stabilizing system and suffered almost a ¾ loss of enzyme activity.

The compositions were clear single-phase solutions which remained physically stable after 6 months of storage at both room temperature and 110° F.

What is claimed is:

1. A stabilized aqueous, built, clear, single-phase, enzyme-containing liquid detergent composition comprising:

(a) from about 3 to 10%, by weight, of a surface active nonionic detergent compound;

(b) from about 3 to 15%, by weight, of a surface active amphoteric detergent compound;

(c) from about 5 to 25%, by weight, of a water-soluble non-phosphate detergent builder salt;

(d) an effective amount of an enzyme or enzyme mixture selected from the group consisting of alkaline protease enzymes and alpha-amylase enzymes;

(e) from about 3 to 15%, by weight, of an enzyme stabilizing system consisting essentially of (i) glycerine and (ii) a boron compound selected from the group consisting of boric acid, boric oxide and alkali metal borates capable of reacting with said glycerine; and (f) from about 30–85%, by weight, water; said liquid detergent composition being substantially free of cross-linked polyacrylate polymers.

2. A detergent composition according to claim 1 wherein said nonionic detergent compound is a water-soluble $C_2$–$C_3$ alkoxylated $C_{10}$–$C_{18}$ alkanol.

3. A detergent composition according to claim 1 wherein said builder salt is sodium citrate.

4. A detergent composition according to claim 1 wherein said builder salt is sodium nitrilotriacetate.

5. A detergent composition according to claim 1 which contains less than about 5%, by weight, of a surface active anionic detergent compound.

6. A detergent composition in accordance with claim 1 which is substantially free of a $C_{10}$–$C_{18}$ alkyl benzene sulfonate anionic detergent.

7. A detergent composition according to claim 1 wherein said boron compound is an alkali metal borate.

8. A detergent composition according to claim 7 which contains from about 3 to 7%, by weight, of said glycerine and from about 1 to 4%, by weight, of said alkali metal borate.

9. A detergent composition according to claim 1 which is substantially free of a phosphate detergent builder salt.

10. A detergent composition in accordance with claim 1 wherein said alkali metal borate is borax.

11. A detergent composition in accordance with claim 1 wherein said builder salt is present in an amount of from about 10 to 20%, by weight.

12. A method of laundering comprising contacting the stained and/or soiled fabrics to be laundered with an enzyme-containing, built, clear single-phase liquid detergent composition comprising:

(a) from about 3 to 10%, by weight, of a surface active nonionic detergent compound;

(b) from about 3 to 15%, by weight, of a surface active amphoteric detergent compound;

(c) from about 5 to 25%, by weight, of a water-soluble non-phosphate detergent builder salt;

(d) an effective amount of an enzyme or enzyme mixture selected from the group consisting of alkaline protease enzymes and alpha-amylase enzymes;

(e) from about 3 to 15%, by weight, of an enzyme stabilizing system consisting essentially of (i) glycerine and (ii) a boron compound selected from the group consisting of boric acid, boric oxide and alkali metal borates capable of reacting with said glycerine; and (f) from about 30–85%, by weight, water; said liquid detergemt composition being substantially free of cross-linked polyacrylate polymers.

13. A method according to claim 12 wherein said nonionic detergent compound is a water-soluble $C_2$–$C_3$ alkoxylated $C_{10}$–$C_{18}$ alkanol.

14. A method according to claim 12 wherein said composition contains less than about 5%, by weight, of a surface active anionic detergent compound.

15. A method according to claim 12 wherin said composition is substantially free of a $C_{10}$–$C_{18}$ alkyl benzene sulfonate anionic detergent.

16. A method according to claim 12 wherein said boron compound is an alkali metal borate.

17. A method according to claim 16 wherein said composition contains from about 3 to 7%, by weight, of said glycerine and from about 1 to 4%, by weight, of said alkali metal borate.

18. A method according to claim 12 wherein said alkali metal borate is borax.

19. A method according to claim 12 wherein said non-phosphate builder salt is present in the composition in an amount of from about 10 to 20%, by weight.

* * * * *